United States Patent [19]

Lee

[11] Patent Number: 5,062,644

[45] Date of Patent: Nov. 5, 1991

[54] GOLF BALL

[75] Inventor: Young-Bum Lee, Seoul, Rep. of Korea

[73] Assignee: Accufar Golf Co., Ltd., Mokpo, Rep. of Korea

[21] Appl. No.: 538,028

[22] Filed: Jun. 13, 1990

[30] Foreign Application Priority Data

Nov. 6, 1989 [KR] Rep. of Korea ..... 89-16030

[51] Int. Cl.[5] ..... A63B 37/14

[52] U.S. Cl. ..... 273/232; 40/327

[58] Field of Search ..... 273/232, 220, 62; 40/327

[56] References Cited

U.S. PATENT DOCUMENTS 4,560,168 12/1985 Aoyama ..... 273/232
4,877,252 10/1989 Shaw ..... 273/232
4,960,282 10/1990 Shaw ..... 273/232

FOREIGN PATENT DOCUMENTS 80-1003 9/1980 Rep. of Korea ..... 273/232

*Primary Examiner*—George J. Marlo
*Attorney, Agent, or Firm*—Flynn, Thiel, Boutell & Tanis

[57] ABSTRACT

A golf ball surface is divided into faces of an icosidodecahedron consisting of 20 regular triangles and 12 regular pentagons, each of said 20 regular triangles is subdivided into 4 small regular triangles, each of said 12 regular pentagons is subdivided into 5 isosceles triangles, 6 dividing lines of the spherical surface occur when structured as above, and on the remaining 5 dividing lines except 1 mold parting line of 6 dividing lines are crossed the dimples, said dimples aren't crossed on the center of said regular triangles and pentagons, and said dimples intervals are arranged in a spaced circle on the basis of on the center of the respective regular triangles and pentagons.

13 Claims, 7 Drawing Sheets

FIG. 5. A
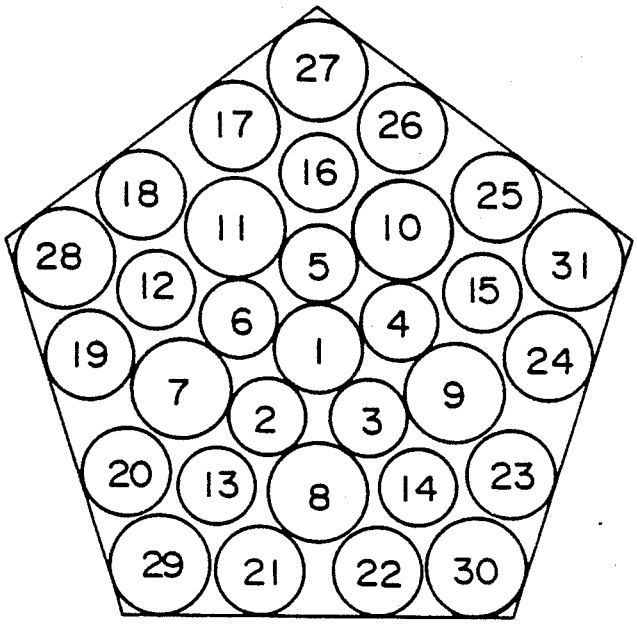
FIG. 5. B
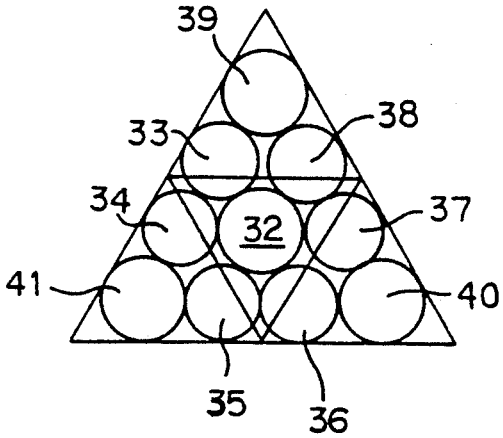

GOLF BALL

BACKGROUND OF THE INVENTION

1. Field of the Invention

The present invention generally relates to golf balls, and more particularly, to a golf ball in which the spherical surface is divided into 12 regular pentagons and 20 regular triangles corresponding to the faces of an icosidodecahedron, and to a golf ball with more exterior beauty in which the dimples of the ball cover are arranged not to visibly be distinguished from a mold parting line resulting from a two-part and without dimple free areas which arise from escaping dimple arrangement near the mold parting line and other symmetrical axes. Further, the golf ball of the present invention provides the largest efficiency of a flying distance and an accurate, and consistent flying orbit by extending the flying time of the golf ball after maximizing a dynamic lift and minimizing an air resistance against the golf ball.

2. Description of the Prior Arts

In general, there are two factors to fly a golf ball. Firstly, there is the initial velocity of a golf club head when the golf ball is struck by the club head, and secondly, there is the action of the dimple and back spin of the ball. Therefore, the large flying distance is produced by a long flying time being caused by the dynamic lift by means of such dimple and back spin action. For the conventional golf ball, because of a mold parting line resulting from molding the golf ball cover and a number of symmetrical axes to balance the spherical surface of the ball, the various limits which following the non-distribution area of the dimple happen when the dimples are arranged, thusly, the golf balls didn't receive the maximum dynamic lift. Accordingly, it was difficult to fly the golf ball in the desired direction. The flying distance was also shortened.

Additionally, to obtain optimum aerodynamic properties and an excellent flying ability of the golf ball, there were attempts to vary the size and depth of the dimples and the geometric arrangement of dimples on the surface.

U.S. Pat. No. 4,560,168 describes a golf ball in which the spherical surface of the ball is subdivided into twenty spherical surface triangles corresponding to the face numbers of a regular icosahedron, the respective spherical surface triangles are subdivided into four small triangles, and the dimples are arranged not to intersect with some sides of the central triangles. Accordingly, there are 6 symmetrical axes which don't intersect with a plurality of dimples formed on the spherical surface and any other dimples.

Alternatively, U.S. Pat. No. 4,142,727 describes a golf ball in which the spherical surface of the ball is subdivided into twelve areas corresponding to the faces of a regular dodecahedron. The surface includes 12 to 30 rectangular bald patches or dimple-free areas. The patent also refers to dividing the surface of the ball into areas corresponding to an octahedron or an icosahedron. In each case, however, from 12 to 30 bald patches will be present.

The Republic of Korea patent Gazette No. 80-1003 describes a golf ball in which the non-distribution area of at least 20 to 30 dimples is symmetrically disposed on the spherical surface of the ball and said dimple non-distribution area includes spherical rectangular bald patches consisting of at least half width of mean diameter of said dimples and at least two-fold of mean surface area of said dimples.

In respect of the dimple arrangement of the golf ball concerning with said patent Gazettes, because of a mold parting line resulting from molding the golf ball cover and a number of dividing lines for uniformity of the golf ball, various problems occur when the dimples are arranged, and thusly, said dimple arrangement consists of the non-distribution area and the symmetrical axes of dimple-free areas. This causes the golf ball not to be lifted at maximum when the golf ball is flying. Accordingly, it is a drawback that the flying distance of the golf ball is shortened.

SUMMARY OF THE INVENTION

It is an object of the present invention to provide a golf ball in which the non-distribution area of the dimples is minimized and the accuracy is maximized and the quantity of the spin is extended by disposing various dimples on the remaining dividing line except a mold parting line. Further, the flying distance can be maximized by extending the flying time of the ball and lessening the overall resistance of the air upon the golf ball after moving the turbulence flow critical point to the back face of the ball at maximum and maximizing the reverse pressure of the proceeding direction of the golf ball. Accordingly, the basic structure of the spherical surface of the golf ball according to the present invention forms the icosidodecahedron consisting of 12 regular pentagons and 20 regular triangles, each of said 12 regular pentagons is subdivided into 5 isosceles triangles, also, each of said 20 regular triangles is subdivided into 4 regular triangles. Therefore, said structure of the spherical surface of the golf ball consists of 240-hedron. When structured as above, 6 dividing lines of the spherical surface occur not to visibly be distinguished from a mold parting line resulting from molding the golf ball cover, the dimple arrangement, is absent on said mold parting line and the other five dividing lines cross the several dimples on the symmetrical line. That is, the dimples which are evenly disposed in a uniform and regular ratio cross the remaining 5 dividing lines except 1 mold parting line of 6 spherical surface dividing lines of the icosidodecahedron. Therefore, the non-distribution area of the dimples is minimized by disposing said dimples on the boundary line between all pentagons and triangles. On the other hand, the exterior beauty and efficiency according to said dimple arrangement is maximized due to evenly and uniformly distributed dimples without dimple free areas and the width of the mold parting line being minimized.

Accordingly, the mold parting line is symmetrical since it is only a spherical axis, the area consisting of dimples to the spherical surface can be maximized if various sized dimples are used and distributed uniformly and the area without dimples is relationally minimized. When the golf ball flies into the air layer, the turbulence flow on the spherical surface is efficiently produced and the initial velocity of the ball falls within the interval of the critical velocity while the accuracy of a desired flying distance and a flying orbit is maintained by increasing the reverse pressures and decreasing a total resistance of air.

BRIEF DESCRIPTION OF THE DRAWINGS

The invention will be explained in conjunction with illustrative embodiments shown in the accompanying drawing, in which:

FIGS. 5A and 5B illustrate two-dimensionally the dimple patterns of a regular pentagon and a regular triangle of the icosidodecahedron designed on the spherical surface of golf-ball.

DESCRIPTION OF SPECIFIC EMBODIMENTS

Figure 1:
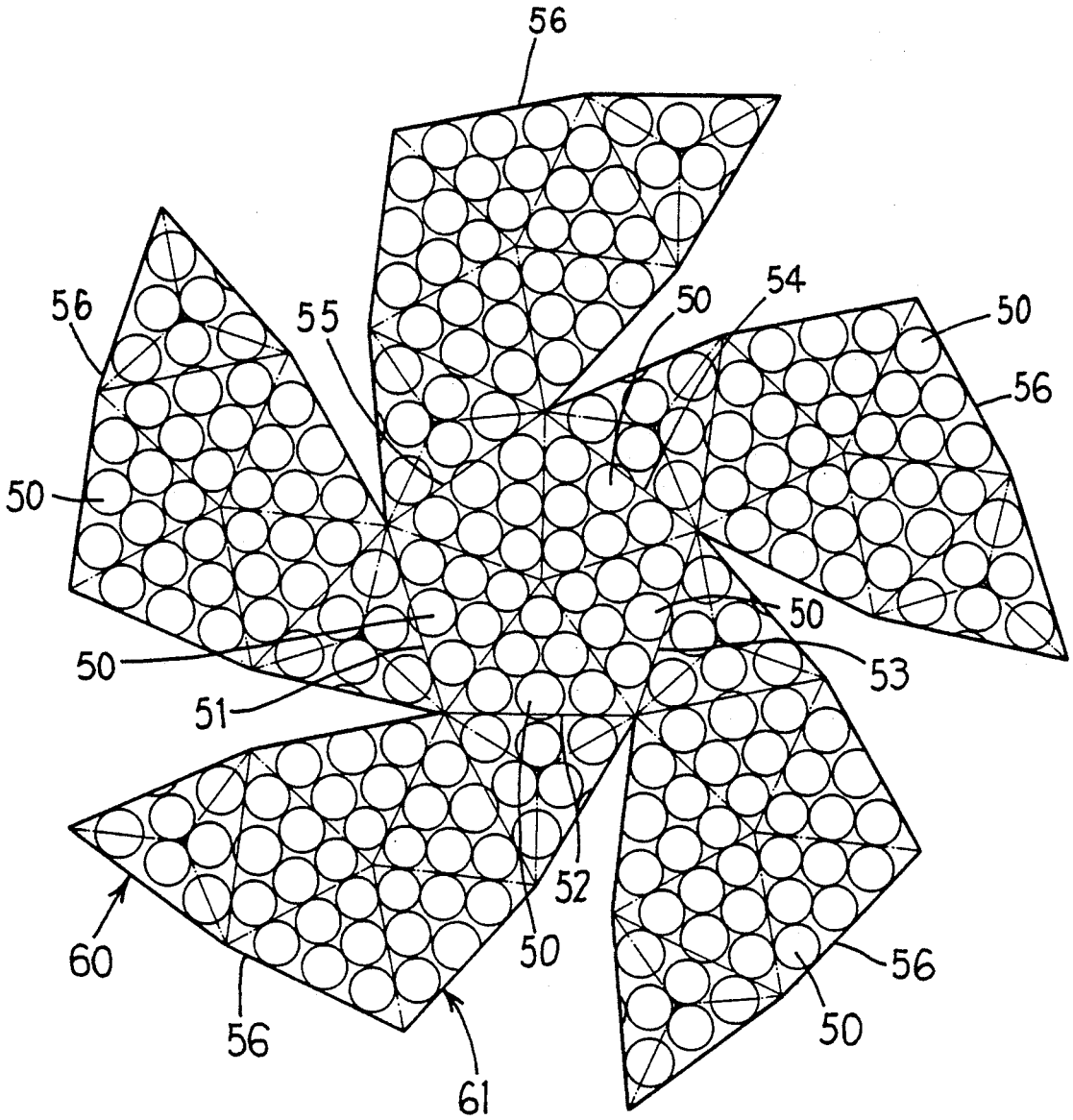
FIG. 1 illustrates the geometric arrangement of a half-spherical surface of a golf ball in accordance with the present invention.
Figure 2:
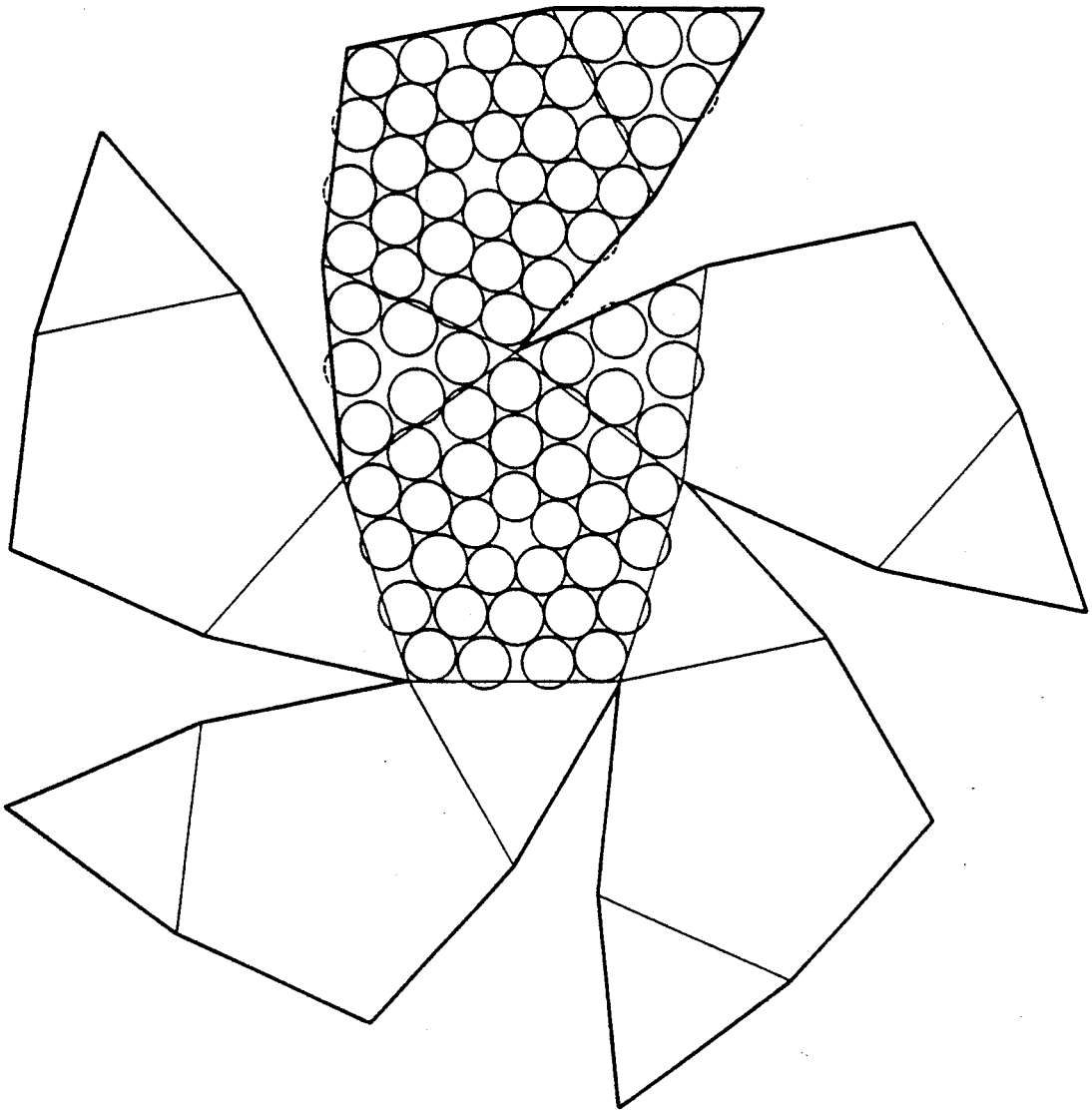
FIGS. 2 through 3 illustrate dimple patterns in which the dimple extend across the dividing line.

FIG. 1 illustrates the geometric arrangement of a half-spherical surface of a golf ball in accordance with the present invention. The geometrical basic structure of the golf ball spherical surface is obtained by dividing into 20 regular triangles, such as 60 and 12 regular pentagons such as 61, corresponding to the icosidodecahedron.

Some dimples 50 intersect 5 of the circular dividing lines 51–55, but the circular mold parting line 56 of the ball does not pass through any dimples. Therefore, only said parting line is the dividing line. Further, when the midpoints of sides of a regular triangle passing the dividing line of said regular triangle are connected with each other, each of 20 regular triangles can be subdivided into 4 small regular triangles, and 3 isosceles triangles can be formed by connecting the three apexes of said regular triangle with the center of said regular triangle.

The number of sides structured as above can consist of a total 240-hedron, and 6 dividing lines of the ball cover occur, and on the remaining 5 dividing lines except 1 mold parting line of 6 dividing lines are disposed some of the dimples. There are three dimple sizes and the range of the dimple size is within 2.5~3.5 mm. When regular pentagons of the spherical surface of the ball are subdivided into 5 isosceles triangles, each of the isosceles triangles has 3 complete dimples, then, on the dividing line is crossed the center of 2 dimples. On the side adjoining between a regular triangle and a regular pentagon are crossed some of the dimples, regular triangles must have 10 complete dimples and, particularly, on the center of all regular triangles must be disposed 1 dimple.

On the other hand, with reference to the dimple structure of the spherical surface of the golf ball consisting of 12 regular pentagons and 20 regular triangles, on all apexes (i.e. vertices) there are no dimples, and the dimple interval is different from each other on the basis of the dimples respectively arranged on the center of a regular triangle and a regular pentagon, i.e. said dimples are arranged in a spaced circle.

Figure 4:
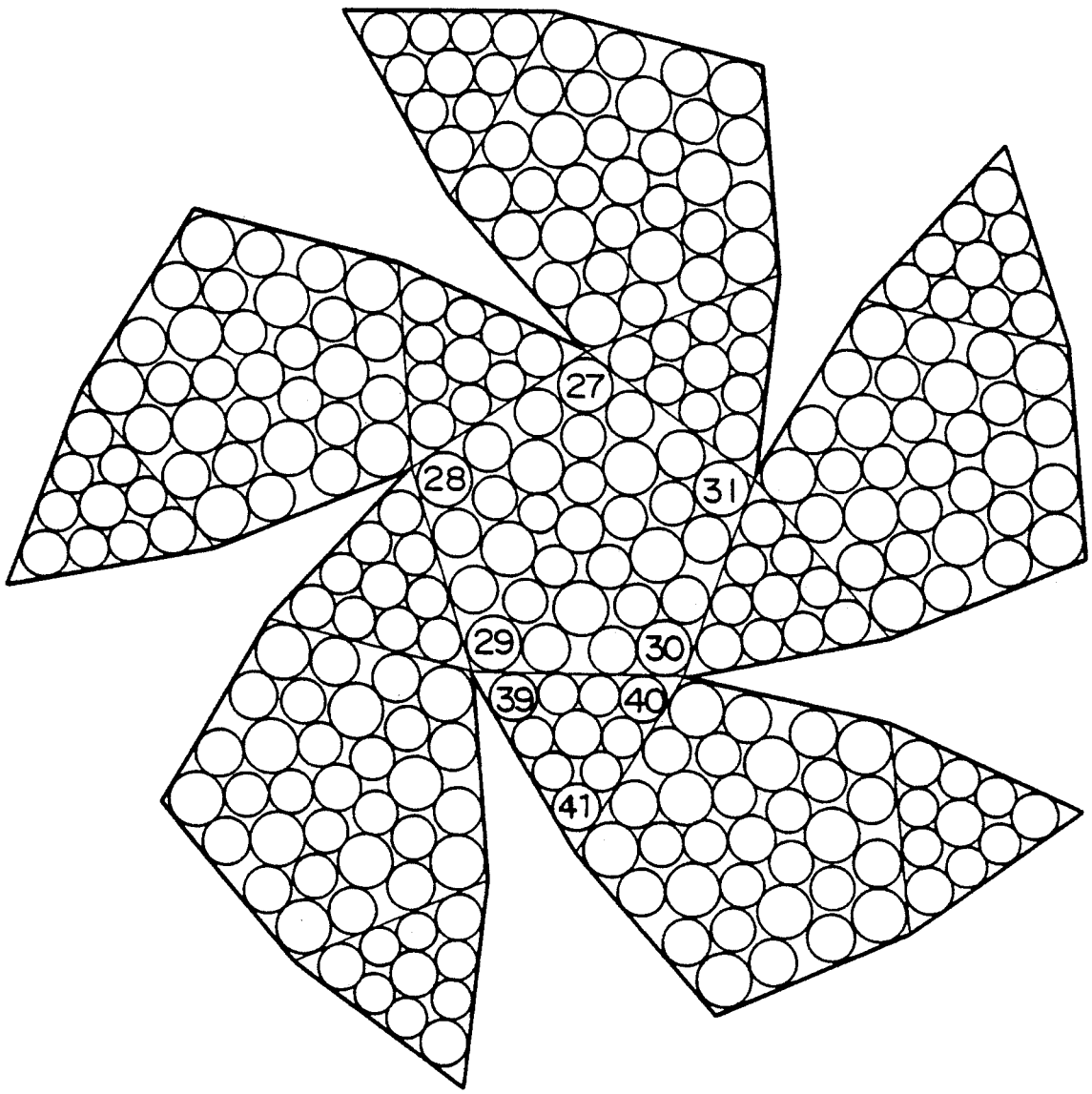
FIG. 4 illustrates the geometric arrangement of a half-spherical surface of a golf-ball in accordance with another embodiment of the present invention.
Figure 6:
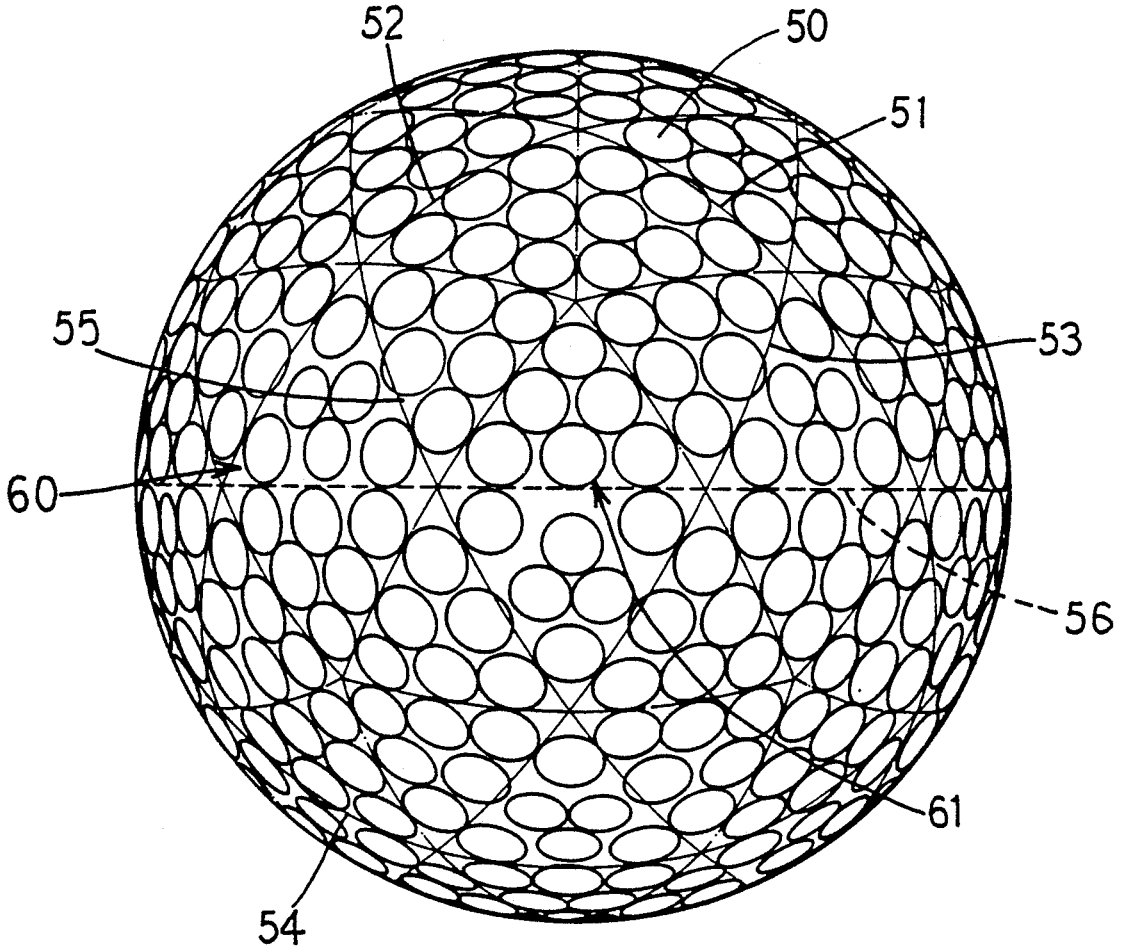
FIG. 6 illustrates the polar perspective view showing the dimple patterns in accordance with the present invention.

Alternatively, referring to FIG. 4 and FIG. 5 according to other embodiments of the present invention, when a regular pentagon is subdivided into 5 small isosceles triangles and a regular triangle is subdivided into 3 small regular triangles, then, the diameters of the dimples 1, 17, 18, 19, 20, 21, 22, 23, 24, 25, 26, 32, 39, 40, 41 (as noted in FIG. 5A) are identical to each other, the diameters of the dimples 2, 3, 4, 5, 6, 12, 13, 14, 15, 16, 33, 34, 35, 36, 37, 38 are also identical to each other, and diameters of the dimples 7, 8, 9, 10, 11, 27, 28, 29, 30, 31 are also identical to each other. Therefore, said dimples are disposed in a spaced circle on the basis of the center.

On the other hand, referring to the dimple structure consisting of 12 regular pentagons and 20 regular triangles, no dimples are disposed on the apexes. Further, the dimples are arranged in regular interval, for example, in a spaced circle so that they can't be disposed on the center points of regular pentagons and regular triangles.

Figure 3:
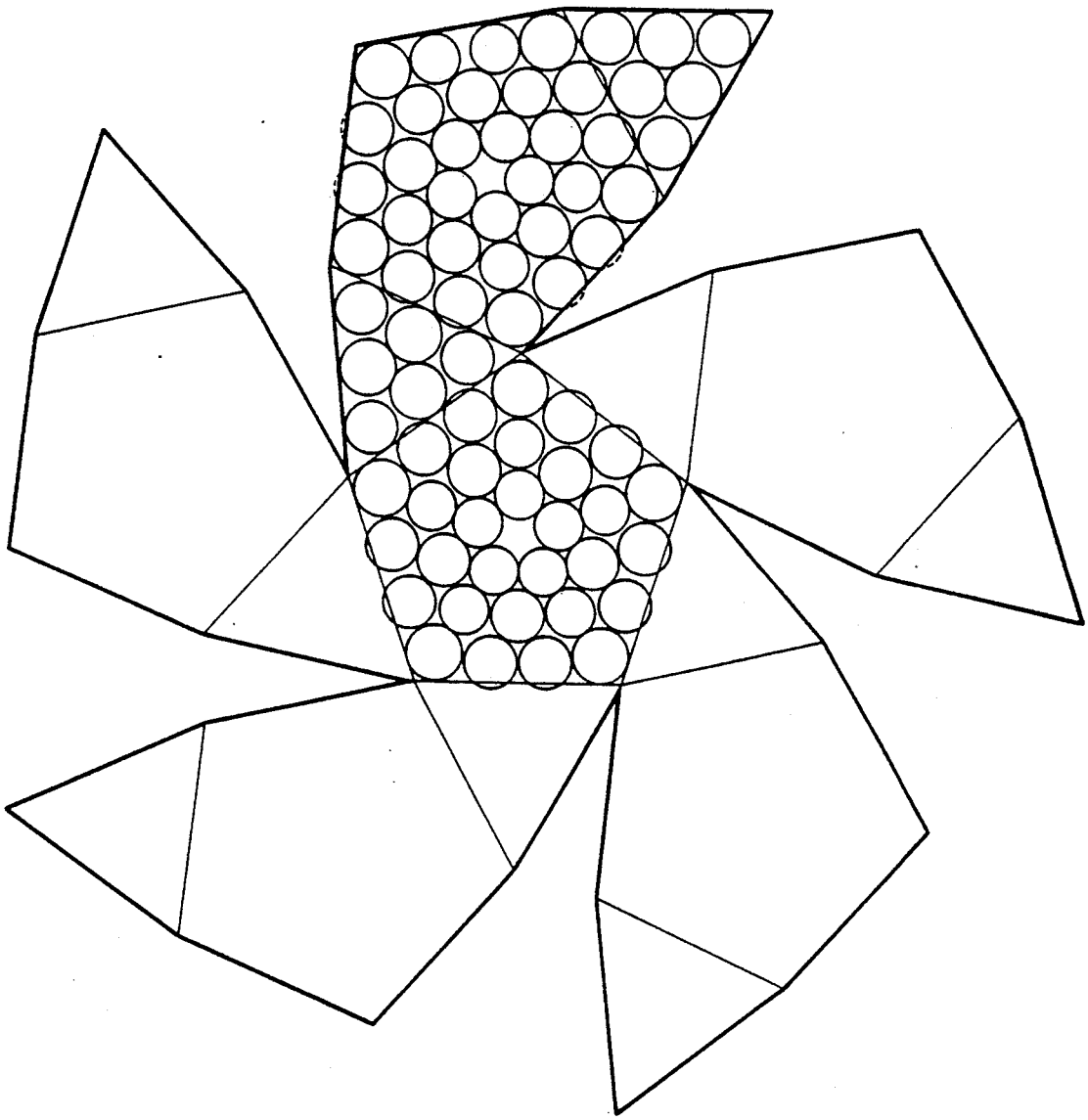
Figure 7:
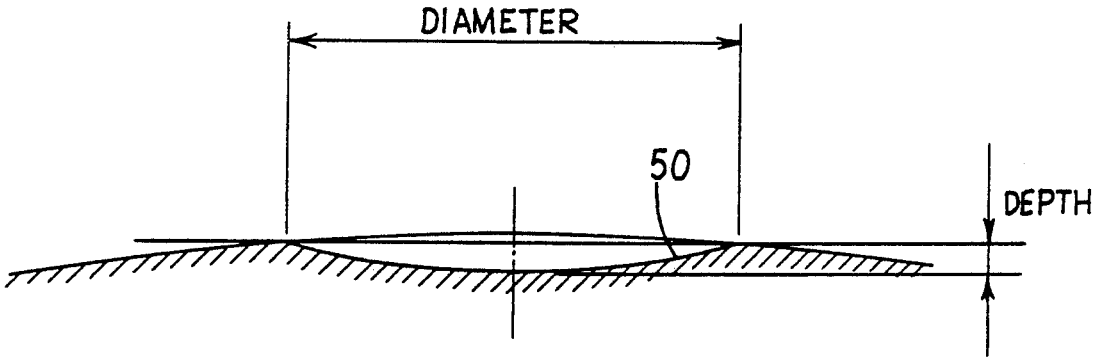
FIG. 7 illustrates the relationship between dimple depth and dimple diameter according to the present invention.

Furthermore, as 3 dimples intersect with the boundary line which adjoins 12 regular pentagons and 20 regular triangles except a mold parting line as shown in FIG. 3, with reference to the golf ball of the present invention, on the boundary line must be crossed dimples of one and above. It is desirable that each of the dimples has a depth in the range of 4~7 precent of the respective dimple diameter (see FIG. 7).

As mentioned above, as the golf ball according to the present invention adopts the icosidodecahedron consisting of 12 regular pentagons and 20 regular triangles, the dimples of the present invention are arranged not to be visibly distinguished from a mold parting line resulting from molding the golf ball cover, and therefore, the exterior beauty of the golf ball increases more and more, the distribution area of the dimple on the spherical surface of the ball is maximized and the non-distribution area without having dimples is relationally minimized. When the golf ball flies into the air layer, the turbulence flow on the spherical surface is efficiently produced and the initial velocity of the golf ball having the propulsive force imparted thereto by a golf club head falls within the interval of the critical velocity while the accuracy of a desired flying distance and a flying orbit is maintained by increasing the reverse pressure and decreasing a total resistance of the air.

While in the foregoing specification a detailed description of specific embodiments of the invention has been set forth for the purpose of illustration, it will be understood that many of the details herein given may be varied considerably by those skilled in the art without departing from the spirit and scope of the invention.

I claim:

1. In a golf ball including an outer cover having a spherical outer surface, said spherical outer surface having a plurality of dimples formed therein and arranged in a repeating pattern, said repeating pattern being defined by projecting onto said spherical outer surface the edges of an icosidodecahedron having 20 regular triangular faces and 12 regular pentagonal faces, and the edges of said icosidodecahedron, as projected onto said spherical outer surface, defining 6 circular dividing lines on said spherical outer surface, the improvement comprising:

said outer cover including two molded cover parts having respective hemispherical outer surfaces which adjoin one another along a generally circular mold parting line to define said spherical outer surface, said mold parting line being coincident with one of said 6 dividing lines, all of said dimples being arranged in nonintersecting relationship relative to said mold parting line and the dividing line coincident therewith, and the remaining 5 dividing lines each being intersected by at least one of said dimples, whereby said dimples are arranged evenly and uniformly over said spherical outer surface.

2. A golf ball according to claim 1, wherein each of said dimples is arranged in nonoverlapping relationship relative to the other said dimples.

3. A golf ball according to claim 2, wherein some of said dimples are spaced from adjacent dimples by respectively different distances, said plurality of dimples including a plurality of dimple groups associated with each said face of said icosidodecahedron, the dimples of each said dimple group being arranged in a circle which is concentric with the associated face of said icosidodecahedron.

4. A golf ball according to claim 3, wherein said plurality of dimples includes dimples which are respectively concentric with said faces of said icosidodecahedron.

5. A golf ball according to claim 4, wherein said dimples within each said dimple group are approximately equal in size.

6. A golf ball according to claim 5, wherein said dimples of different said dimple groups differ in size.

7. A golf ball according to claim 4, wherein the vertices of said faces of said icosidodecahedron are free of dimples.

8. A golf ball according to claim 3, wherein the geometric center points of said faces of said icosidodecahedron are free of dimples.

9. A golf ball according to claim 8, wherein the dimples within each said dimple group are approximately equal in size.

10. A golf ball according to claim 8, wherein the vertices of said faces of said icosidodecahedron are free of dimples.

11. A golf ball according to claim 2, wherein each of said dimples has a depth which is about 4 to 7 percent of its diameter.

12. A golf ball according to claim 11, wherein each of said dimples has a depth which is approximately 5.5 percent of its diameter.

13. A golf ball according to claim 1, wherein each of said 12 regular pentagonal faces is subdivided into 5 isosceles triangles, each of said 20 regular triangular faces being subdivided into 4 smaller regular triangles.

* * * * *